US006577050B2

(12) United States Patent
De Marino et al.

(10) Patent No.: US 6,577,050 B2
(45) Date of Patent: Jun. 10, 2003

(54) CATHODE RAY TUBE HAVING A FRAME/ MASK ASSEMBLY

(75) Inventors: Massimo De Marino, Colleferro (IT); Pierluigi Testa, Rome (IT)

(73) Assignee: Thomson Licensing S. A., Boulogne Cedex (FR)

( * ) Notice: Subject to any disclaimer, the term of this patent is extended or adjusted under 35 U.S.C. 154(b) by 175 days.

(21) Appl. No.: 09/815,106

(22) Filed: Mar. 22, 2001

(65) Prior Publication Data

US 2002/0135288 A1 Sep. 26, 2002

(51) Int. Cl.[7] ..... H01J 29/80
(52) U.S. Cl. ..... 313/407; 313/402
(58) Field of Search ..... 313/402–407

*Primary Examiner*—Vip Patel
(74) *Attorney, Agent, or Firm*—Joseph S. Tripoli; Joseph J. Laks; Carlos M. Herrera

(57) ABSTRACT

A cathode ray tube comprising a color selection mask made from a material in tension and having a relatively low coefficient of thermal expansion, supported by a frame made from a material having a higher coefficient of thermal expansion. Along at least two sides of the frame are disposed two metal inserts made from a material whose coefficient of thermal expansion is similar to that of the mask. The inserts are secured to the opposed sides of the frame at their middle, and the mask is welded to the inserts. The mechanical problems relating to the differences in expansion of the materials making up the mask and the frame, during the high-temperature tube manufacturing steps, are avoided.

10 Claims, 3 Drawing Sheets

CATHODE RAY TUBE HAVING A FRAME/ MASK ASSEMBLY

FIELD OF THE INVENTION

The invention relates to a colour cathode ray tube and more particularly to the frame/colour selection mask system disposed inside the glass envelope of the tube. The invention finds its application in any type of tube comprising a colour selection mask and is more particularly adapted to tubes whose mask is held in tension by the frame to which it is secured.

BACKGROUND OF THE INVENTION

Conventional cathode ray tubes comprise a colour selection mask situated a precise distance from the inside of the glass faceplate of the tube, on which faceplate are deposited arrays of red, green and blue luminophores. Under the influence of three electron beams each corresponding to a specified primary colour, the arrays of luminophores allow the reproduction of images on the screen, the mask allowing each specified beam to illuminate only the luminophore of the corresponding colour.

The colour selection mask must be disposed and held during the operation of the tube in a precise position inside the said tube. The holding functions are carried out by virtue of a generally very rigid rectangular metal frame to which the mask is conventionally welded. The frame/mask assembly is mounted in the faceplate of the tube by virtue of elastic suspension means comprising at least three metal parts welded to the frame, each of the said parts comprising a spring-forming and apertured end intended to be engaged in one of the metal studs integral with the glass faceplate. Two arrangements of the suspension means are conventionally used: either in the middles of the sides of the frame, or at its corners.

The current tendency is for tubes whose faceplate is ever more flat, moving towards totally flat faceplates. To make tubes comprising such a faceplate entails a technology consisting in using a flat mask, held in tension in at least one direction. Such structures are described for example in U.S. Pat. No. 4,827,179.

The colour selection mask consists of a metal foil of very small thickness, generally tensioned and secured to a frame of considerable mechanical strength in such a way as to maintain the tension of the mask during the operation of the tube.

Since the mask intercepts more than half the electrons emitted by the electron gun of the tube during the operation of the latter, its temperature rises rapidly, causing the expansion of at least certain zones of the said mask; this results in a phenomenon of reduction in its tension and in its flatness. The mask no longer being flat, it follows that the points of impingement of the three electron beams on the screen of the tube no longer correspond to the ad hoc lines of luminescent materials, thus causing a decoloration of the image reproduced on the said screen.

A first solution consists in using a mask made from a material of very low coefficient of thermal expansion such as, for example, Invar for which this coefficient is of the order of 1.25 $10^{-6}$/° C. The mask will then expand very little during the operation of the tube, thus affording a guarantee of its flatness. Consequently, it will be possible to use a relatively low mask tension, for example of the order of 5 kg/mm$^2$, to guarantee its flatness without fear of it becoming slack during the operation of the tube; the metal support frame will therefore have a mechanical strength in relation to the low tension applied.

A second solution consists in using a standard steel mask of larger coefficient of thermal expansion, of the order of 1.5 $10^{-5}$/° C., which will have to be held flat with a much larger tension of possibly up to ten times the tension which has to be applied to an Invar mask. This necessitates the use of a holding frame whose mechanical strength is considerable, this mechanical strength of the frame being obtained through the considerable amount of material used. This solution then exhibits the drawbacks of high material costs and high weight.

The solution consisting in using a mask made of a material with a low coefficient of thermal expansion also exhibits a number of drawbacks, however:

The tension mask cannot be welded directly to the frame which holds it in tension unless the said frame is made from a material whose coefficient of thermal expansion is similar to that of the mask, and it cannot in particular be made from standard steel. This is because, during the phases of the tube manufacturing process, the frame/mask assembly is raised to temperatures above 400° C.; at these temperatures the differential in the expansion of the materials where the mask is welded to the frame may cause local failures of the weld and hence local and random modifications to the tension of the mask, modifications giving rise to defects in the colours of the image reproduced on the screen of the tube.

This solution therefore necessitates the use of a frame and a mask whose coefficients of thermal expansion are similar and small, for example made of Invar; however, this type of material is much more expensive than standard steel, around three times more expensive, thereby very considerably increasing the cost of the frame and consequently of the manufactured tube.

There is a need to allow the use of a mask made of a material of low coefficient of thermal expansion associated with a frame made of conventional steel in such a way as to obtain a frame/mask assembly of low cost and low weight.

SUMMARY OF THE INVENTION

To do this, the frame/mask assembly according to the present invention comprises a colour selection mask and a substantially rectangular metal frame for supporting the mask and holding it in tension in at least one direction, the mask being made from a material whose coefficient of thermal expansion is less than the coefficient of thermal expansion of the material constituting the majority of the frame. Along at least two opposed sides of the frame are disposed two metal inserts extending along and secured to said opposed sides, and said metal inserts being made from a material whose coefficient of thermal expansion is similar to that of the mask, the mask being secured to the frame, for example by welding to the two metal inserts.

BRIEF DESCRIPTION OF THE DRAWINGS

The invention will be better understood with the aid of the following description and of the figures among which.

DESCRIPTION OF THE PREFERRED EMBODIMENTS

Figure 1:
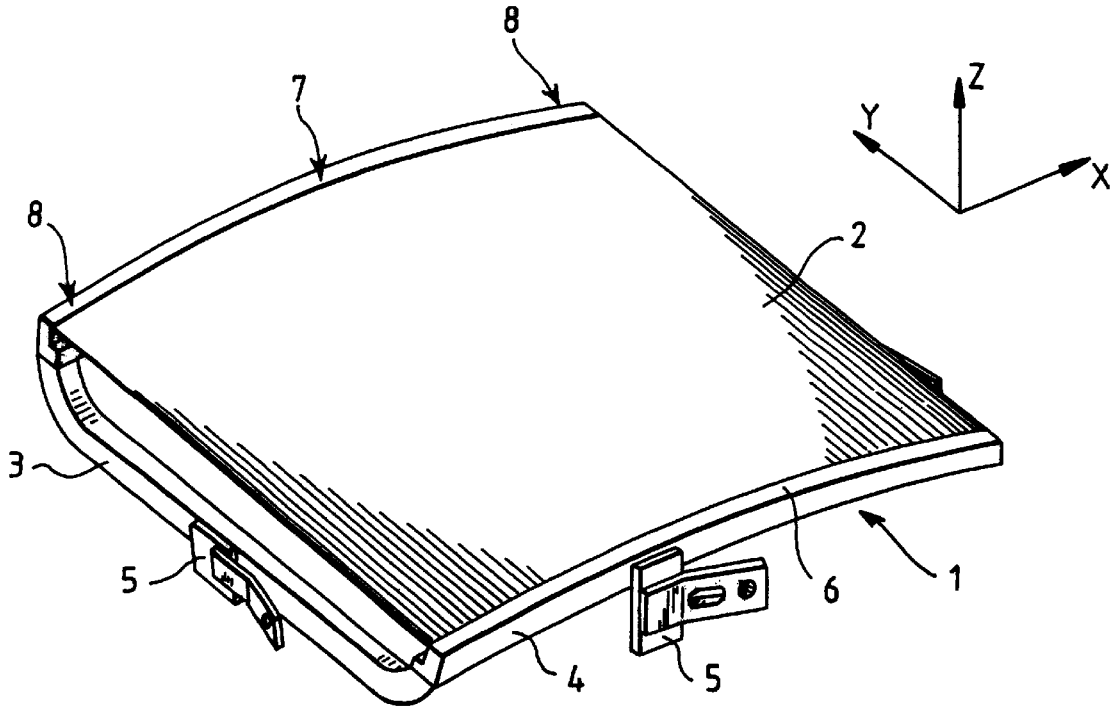
FIG. 1 represents an isometric perspective view of a frame/mask assembly according to the state of the art.

FIG. 1 illustrates a frame/mask assembly according to the state of the art such as described in Patent No. GB2308223. The directions along X, Y, Z, respectively, represent the directions along the horizontal and vertical axes and the main axis of the tube perpendicular to the surface of the display screen. The substantially rectangular frame 1 is composed of two horizontal long sides 4 and of two vertical short sides 3. The frame 1 holds a colour selection mask 2 in tension along at least one direction, parallel to the short sides of the frame. Suspensions 5 are intended to cooperate with metal studs inserted into the skirt of the faceplate of the cathode ray tube so as to keep the frame/mask assembly a precise distance from the screen of the tube.

The quality of the welding of the mask 2 along the edges of the sides 4 of the frame is what guarantees that the tension of the said mask will be maintained according to preset values with, for example, a higher tension in the middle 7 of the long sides and a lower tension at the end 8 of the said sides 4. The variations in tension along the sides 4 depends on the size of the frame and on its geometry. For example, a mask for a 16/9 format tube, owing to its considerable length along the horizontal X axis relative to its length along the vertical Y axis, will have to be held in tension according to a greater ratio of its tension at its middle 7 to its tension at its ends 8 than for a mask for a 4/3 format tube, this being so as to ensure that the surface of the mask will remain at the nominal distance from the screen of the tube without tending to sag at its middle 7.

To avoid the problems related to the thermal expansion of the mask during the steps of the tube manufacturing process and during the normal operation of the latter, constructors tend to use, to fabricate the mask, materials having a low coefficient of thermal expansion. The material most widely used in this sector is Invar, consisting of an iron-nickel alloy with around 36% nickel.

Furthermore, the fact of using a mask manufactured from a material such as Invar has hitherto made it necessary for the constituent material of the frame to also be a material with a low coefficient of thermal expansion. This is because it is difficult to weld an Invar mask to a frame made of standard steel; moreover, the very different thermal expansions of the two materials would compromise the strength of the welds during the tube manufacturing steps carried out at more than 400° C. and possibly culminating in the failure of some of them. However, the use of an Invar frame to avoid the drawbacks described earlier has the major drawback of being very expensive.

Figure 2:
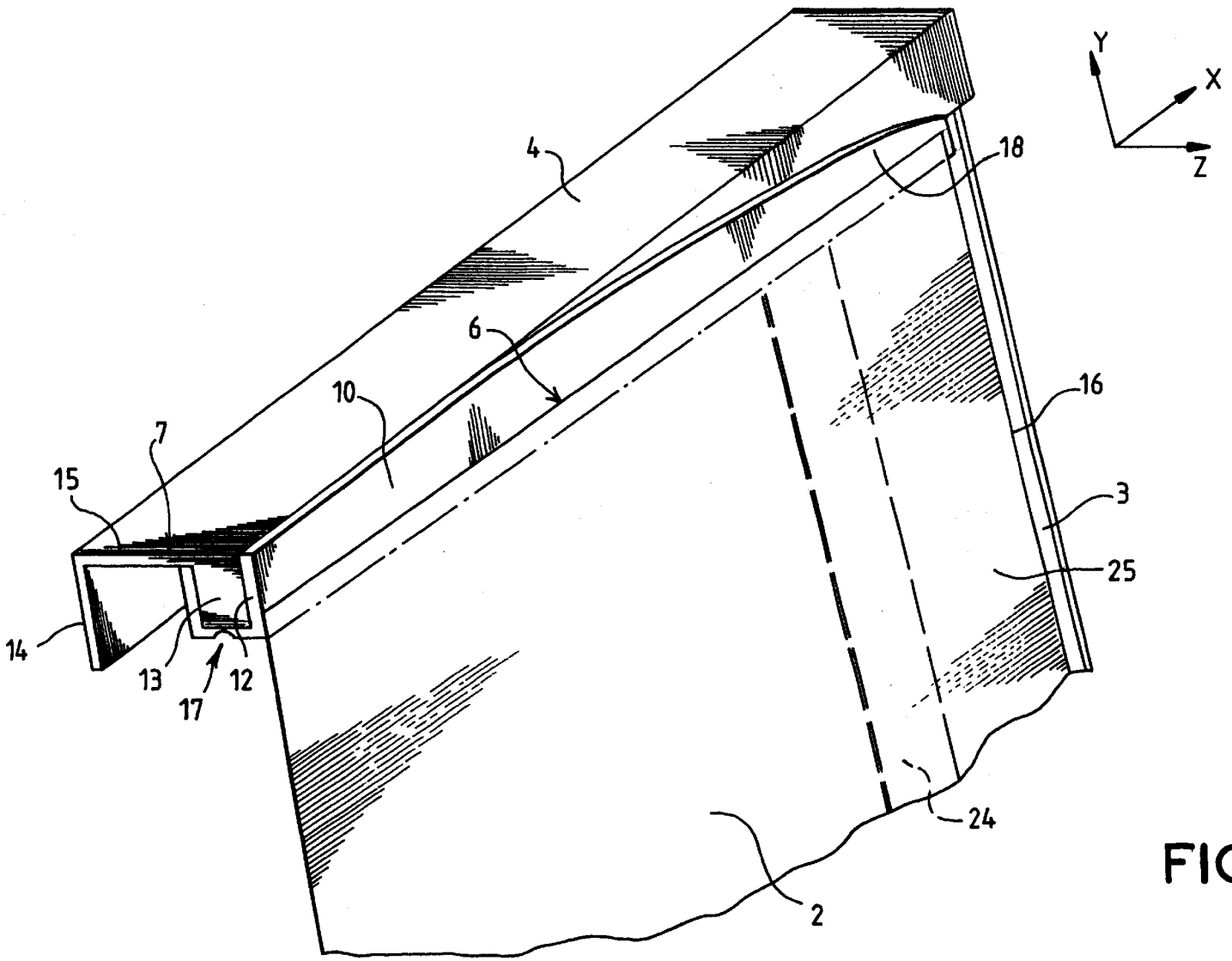
FIG. 2 illustrates a sectional perspective view of a quarter of the frame/mask assembly according to one embodiment of the invention.

FIG. 2 illustrates an embodiment of the invention which does not exhibit this defect.

Figure 3:
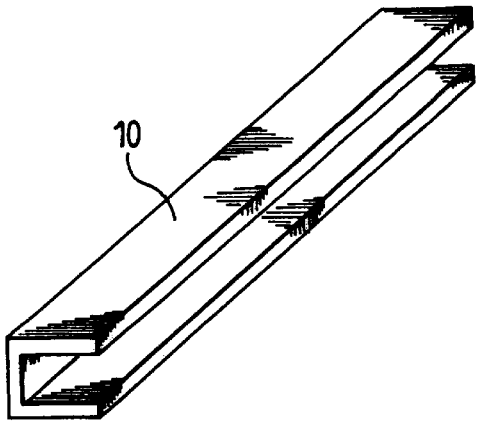
FIG. 3 shows a metal insert serving as interface between the frame and the mask.
Figure 4:
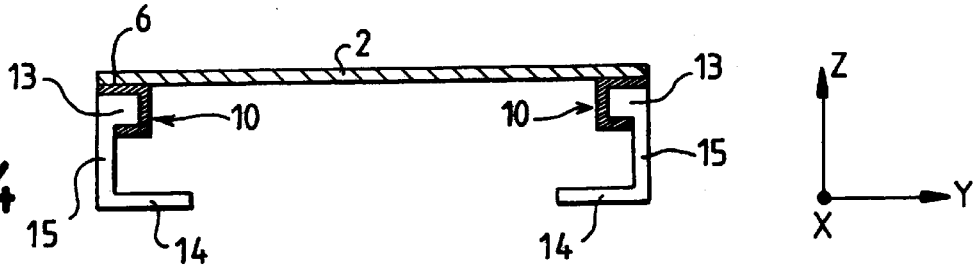
FIGS. 4 to 6 show sections through the frame/mask assembly illustrating various embodiments of the invention.

In FIG. 2 is represented a quarter of the frame/mask assembly seen in perspective and in section. The short sides 3 of the frame have an L cross section, with a vertical flange 25 extending towards the screen of the tube and a horizontal flange 24 extending in a plane substantially parallel to the said screen. Likewise the long sides 4 have a horizontal flange 15 extending towards the screen of the tube and a vertical flange 14 extending in a plane substantially parallel to the screen of the tube. The frame is made from a conventional steel. A mask 2, made from a material whose coefficient of thermal expansion is lower than that of the frame is stretched in at least one direction, for example vertical Y. The long sides 4 of the frame exhibit a horizontal flange 15 whose horizontal edge 13 is of widened cross section towards the inside of the frame and of substantially rectangular shape. A metal insert 10, for example illustrated in FIGS. 3 and 4, of concave cross section, in this case substantially U-shaped, will cover the portion which widens towards the inside of the frame of each of the edges 13 of the two flanges 15. The insert is secured to the middle 7 of each of the opposed sides 4, either by welding 17, or by riveting or bolting, the essential feature being that the zone of joining to the side of the frame is of small length relative to the length of the side 4. The ends 18 of the insert extending around the joining zone 7 are then free to displace, this displacement being however limited in this embodiment to a displacement in an XY plane, substantially parallel to the screen of the tube, this on account of the complementary shapes of the opposing surfaces of the edge 13 of the side 4 of the frame and of the insert 10, the edge 13 serving as a guide for the displacement of the insert. The insert is made from a material of low coefficient of thermal expansion, preferably identical to that of the mask. The mask 2 is tension welded along the vertical Y direction to the outside edges 12 of the insert 10. The tension of the mask will tend to displace each end 18 of the insert in the XY plane as far as a position of equilibrium dependent on the mechanical bending resistance of the insert and on the initial tension of the mask. During the various steps of tube manufacture, the frame/mask assembly will be raised to high temperatures; the insert and the mask will then expand in the same way since they are made from materials having similar thermal behaviour. Furthermore, the insert 10 is free to expand independently of the side 4 of the frame, either side of the joining zone 7; this joining zone must extend over a small length relative to the length of the side 4, preferably over a length not exceeding 25% of the length of the side 4. In this way the expansions of the frame and of the mask are rendered independent of one another. The structure of the invention illustrated by FIGS. 2 and 3, and in section through a plane perpendicular to the surface of the mask by FIG. 4, furthermore exhibits several advantages:

- The mask is tensioned by exerting an identical force along the whole of its ends; after welding its horizontal ends 6 to the insert, the force exerted on the mask is relaxed. As indicated above, the ends 18 of the insert will bend and reach a position of equilibrium for which the tension of the mask will be a maximum at the middle thereof, near to the zone 7, and a minimum near the vertical free ends 16. The distribution of the values of the tension along the welding edge may be precalculated, and the structure of the invention then makes it possible to have a manufacturing process which is simple to implement since the tension to be exerted on the mask is then constant along the whole of the said welding edge.
- The U shape of the cross section of the insert cooperates with the surface facing the edge 13 so as to exercise a role of guidance in the XY plane, so as to prevent the tension exerted on the ends 18 of the insert by the mask from causing this end to rotate through a lever effect, which would deform the surface of the mask.

This structure can therefore also be used advantageously also in frame/mask structures where the frame and the mask are made from identical materials or ones exhibiting coefficients of thermal expansion of similar values.

Figure 5:
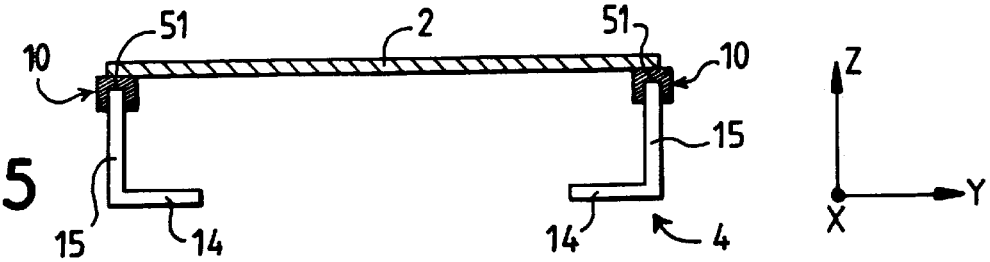

FIG. 5 illustrates another embodiment of the invention resulting from a different positioning of the insert 10. The insert 10 also exhibits a concave inner surface with a preferably U-shaped cross section. The insert is disposed on the edge 51 of the flange 15 in such a way that its concave inner surface surrounds the portion of the said edge which faces the screen of the tube. The insert 10, as in the previous embodiment, is secured to the flange 15 over a zone of small length either side of the middle 7 of the said flange. The mask is tension welded to the insert along its opposite ends 6. In this way the thermal expansions of the mask may take place independently of those of the frame.

Figure 6:
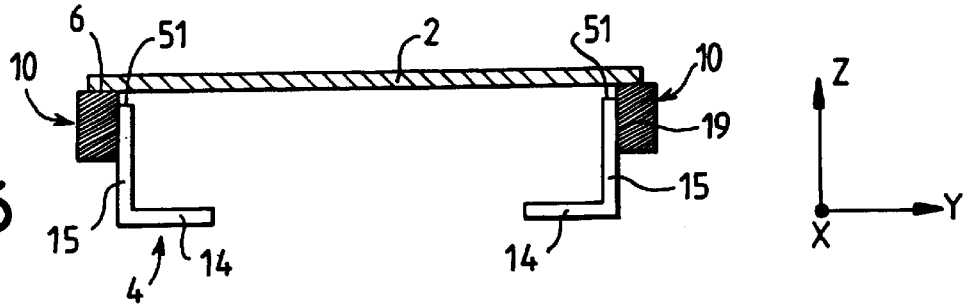

In another embodiment of the invention, illustrated by FIG. 6, the insert possesses a solid cross section 19 and is disposed on the outside portion of the flange 15 in such a way as to overhang the edge 51 of the flange 15. The insert 10 is secured to the flange 15 at its middle 7, and the mask, tensioned beforehand, is welded to the portion of the insert overhanging the edge 51. This embodiment has the advantage of being economical to implement, the simple shapes of the profiles of the flanges and of the inserts making it possible to reduce the cost of these parts.

The embodiments described are not limiting. In the case for example where the mask is stretched in two directions, horizontal and vertical, inserts of the type of those described earlier may advantageously be disposed along the flanges of the horizontal sides 4 and vertical sides 3 of the frame between the mask and the flanges of the said frame.

What is claimed is:

1. A cathode ray tube comprising a colour selection mask and a substantially rectangular metal frame for supporting the mask and holding it in tension in at least one direction, the mask being made from a material whose coefficient of thermal expansion of the material constituting the majority of the frame, wherein, along at least two opposed sides of the frame, are disposed two metal inserts extending along and secured to said opposed sides, said metal inserts being made from a material whose coefficient of thermal expansion is similar to that of the mask, the mask being secured to the frame to the two metal inserts.

2. The tube according to claim 1, wherein the two metal inserts are secured to the opposed sides of the frame in a limited zone of small length relative to the length of the opposed sides.

3. The tube according to claim 2, wherein the inserts are secured to the opposed sides of the frame at their middle.

4. The tube according to claim 1, wherein the frame is made of steel and the inserts are made of Invar.

5. The tube according to claim 1, wherein the cross section of the inserts exhibits a concave inner surface.

6. The tube according to claim 5, wherein the concave inner surface covers a portion of the opposed sides of the frame.

7. The tube according to claim 6, wherein the inserts are disposed on the inner surfaces of two opposed sides of the frame.

8. The tube according to claim 6, wherein the inserts at least partially cover the edges of two opposed sides of the frame.

9. The tube according to claim 1, wherein the inserts are disposed on the outer surfaces of the opposed sides of the frame.

10. The tube according to claim 1, wherein the mask is secured to the frame, for example by welding to four metal inserts themselves secured to each of the four sides of the frame.

* * * * *